US005870659A

United States Patent [19]

Maruyama et al.

[11] Patent Number: 5,870,659

[45] Date of Patent: Feb. 9, 1999

[54] COLOR IMAGE FORMING APPARATUS AND METHOD USING PLURAL PHOTOSENSITIVE DRUMS

[75] Inventors: Kazuo Maruyama; Koji Masuda; Tsutomu Sugimoto, all of Ashigarakami-gun, Japan

[73] Assignee: Fuji Xerox Co., Ltd., Tokyo, Japan

[21] Appl. No.: 922,484

[22] Filed: Sep. 3, 1997

[30] Foreign Application Priority Data

Sep. 5, 1996 [JP] Japan ..... 8-235460

[51] Int. Cl.[6] ..... G03G 15/01

[52] U.S. Cl. ..... 399/299; 399/112

[58] Field of Search ..... 399/112, 113, 399/121, 299, 306, 302; 347/115–118

[56] References Cited

U.S. PATENT DOCUMENTS

| | | | |
|---|---|---|---|
| 3,392,667 | 7/1968 | Cassel et al. . | |
| 4,935,788 | 6/1990 | Fantuzzo et al. | 399/299 |
| 4,987,455 | 1/1991 | Lubberts | 399/299 |
| 5,087,945 | 2/1992 | Randall . | |
| 5,138,389 | 8/1992 | Randall | 399/302 |
| 5,303,013 | 4/1994 | Koike et al. | 399/302 |

FOREIGN PATENT DOCUMENTS

| | | |
|---|---|---|
| A-505 168 | 9/1992 | European Pat. Off. . |
| 0515053 | 11/1992 | European Pat. Off. . |
| U-51-19753 | 7/1949 | Japan . |
| A-59-114242 | 7/1984 | Japan . |
| A-62-50846 | 3/1987 | Japan . |
| A-62-293 263 | 12/1987 | Japan . |
| 01-276158 | 11/1989 | Japan . |
| 02-061663 | 3/1990 | Japan . |
| 02-105168 | 4/1990 | Japan . |
| 03-017668 | 1/1991 | Japan . |
| Y2-6-18364 | 5/1994 | Japan . |

*Primary Examiner*—Robert Beatty
*Attorney, Agent, or Firm*—Oliff & Berridge PLC

[57] ABSTRACT

In an image forming apparatus, three or more (four in this case) cylindrical photosensitive members 1 to 4 on which latent images are formed and developed through use of toner to thereby produce toner images, are arranged so as to share a tangential line in common, and a cylindrical intermediate transfer member 51 is provided. Alternatively, a first unit containing one or more image carriers is positioned next to a first transfer member and a second unit containing one or more image carriers is positioned next to a second transfer member such that there is reflectional symmetry between the first and second units and the transfer members.

13 Claims, 12 Drawing Sheets

COLOR IMAGE FORMING APPARATUS AND METHOD USING PLURAL PHOTOSENSITIVE DRUMS

BACKGROUND OF THE INVENTION

1. Field of the Invention

The present invention relates to an image forming apparatus which forms a color image by the steps of forming a latent image, e.g., an electrostatic latent image, for each of colors, developing the latent image through use of each color toner to thereby produce a monochrome image, superimposing the monochrome images on each other on predetermined paper, and fixing them, and also relates to an image forming method for use with the image forming apparatus. More particularly, the present invention relates to an image forming apparatus which forms a color image by adoption of an image forming method such as an electrophotographic recording method, an electrostatic recording method, ionography, or a magnetic recording method, and also relates to an image forming method for use with the apparatus.

2. Description of the Related Art

Image forming apparatuses which form a color image have widely been in actual use in recent years. Particularly, a color image forming apparatus equipped with a plurality of image carriers has been developed taking full advantage of its superior productivity as a rival to an existing color image forming apparatus which creates one copy by a plurality of rotations (e.g., four rotations). In the color image forming apparatus equipped with a plurality of image carriers (hereinafter referred to as a tandem-type image forming apparatus), the plurality of image carriers, e.g., a plurality of photosensitive members in the case of an electrophotographic color image forming apparatus, are likely to be arranged substantially linearly. For this reason, a charging device, an exposure device, a developing device, and a cleaner, all of which are disposed around each photosensitive member, can be designed so as to have substantially the same construction in common according to the type of the device. Accordingly, the tandem-type image forming apparatus has the advantages of compactness, a low price, and high reliability. Conversely, the apparatus has the disadvantage of the extremely difficulty of registration of color images which is the most important factor in determining color picture quality.

FIG. 21 shows one example of the construction of an existing color image forming apparatus which comprises four photosensitive members 1, 2, 3, 4 and a belt-like transfer member 5 extended across them. A charging device 11, an exposure device 12, a developing device 13, and a cleaner 14 are disposed around the photosensitive member 1; a charging device 21, an exposure device 22, a developing device 23, and a cleaner 24 are disposed around the photosensitive member 2; a charging device 31, an exposure device 32, a developing device 33, and a cleaner 34 are disposed around the photosensitive member 3; and a charging device 41, an exposure device 42, a developing device 43, and a cleaner 44 are disposed around the photosensitive member 4. The belt-like transfer member 5 may be formed into a so-called intermediate transfer member on which toner images are directly placed or into a so-called transfer paper carrier in which toner images are transferred onto the paper sucked by the belt-like transfer member 5.

Next, with reference to the case of the intermediate transfer belt, the formation of an image is described in detail. To begin with, after having been evenly electrostatically charged by the charging device 11, the photosensitive member 1 is exposed to light by the exposure device 12, whereby an electrostatic latent image is formed. The thus-formed latent image is developed and visualized through use of monochrome toner to thereby produce a toner image. The toner image, or the first toner image, is then transferred to the intermediate transfer belt 5 at the position where the toner image comes into contact with the intermediate transfer belt 5. Another color toner image which is similarly formed on the photosensitive member 2 in synchronization with the travel of the first toner image to the position where the first toner image comes into contact with the photosensitive material 2 is superimposed as the second toner image on the first toner image. Similarly, the third and fourth toner images are further superimposed on the thus-superimposed toner images to thereby 4-color superimposed images. These images are transferred as a single image to and fixed on paper (not shown), whereby a color image is formed on the paper.

While passing by the positions where the intermediate transfer belt 5 comes into contact with the respective four photosensitive members 1, 2, 3, and 4, the intermediate transfer belt 5 does not successfully travel along the positions, because it extends/contracts or snakes it's way by dint of the tensile force stemmed from the driving of the intermediate transfer belt 5. As a result, the color toner images become slightly offset from each other, thereby resulting in an undesirable image. Various methods have already been adopted to position the toner images. With one of the methods, a predetermined image is developed, and the position of this developed image is read by an image detection sensor. After the positions of respective color images have been calculated, for example, the starting point for writing operations of the laser light source or the position of a reflection mirror of the light source is finely adjusted. However, this methods requires a very complicated mechanism, thereby resulting in an inevitable increase in the cost.

There is proposed another method in which a plurality of photosensitive members are arranged around a larger cylindrical roll- or drum-shaped rotary transfer member for purposes of preventing dislocation. This method is illustrated in FIG. 22. A rotary transfer member 51 may be an intermediate transfer member or a paper carrier. For the roll- or drum-shaped rotary transfer member 51, it does neither extend/contract nor snake in contrast with the belt. Hence, the rotary transfer member 51 rotates around a drive shaft in a very stable manner, thereby rendering the mutual registration of images comparatively easy. In connection with this method, there is a more desirable method disclosed in Utility Model Publication (Kokoku) No. Hei-6-18364, by which the surface velocity of each of the photosensitive members (image carriers) comparatively easily differs from the surface velocity of the rotary transfer member. The difference in surface velocity between the photosensitive members and the rotary transfer member is intended to prevent the rotary transfer member from receiving a different speed from each of the four photosensitive members while following the rotations of the photosensitive members. The rotary transfer member has the advantage of easy speed control. However, as can be seen from FIG. 22, there is the need for the use of a rotary transfer member having a very large diameter. Further, components to be provided around the respective photosensitive members 1, 2, 3, 4, e.g., the charging devices 11, 21, 31, 41, the exposure devices 12, 22, 32, 42, the developing devices 13, 23, 33, 43, and the cleaners 14, 24, 34, 44 are different in position from each other with reference to the direction of gravity. Therefore, it is impossible to achieve the commonality of components, thereby posing serious problems with regard to cost, reliability, or size. Although it is possible to use a member having a smaller diameter for the rotary transfer member 51, the difficulty of achieving the commonality of constituent components to be provided around the photosensitive member is multiplied greatly.

SUMMARY OF THE INVENTION

The present invention has been contrived in view of the foregoing drawbacks in the background art, and an object of the invention is to provide an image forming apparatus equipped with a plurality of image carriers which enables the realization of the commonality of components or devices provided around each image carrier for forming an image, i.e., a latent image forming device (e.g., a charging device and an exposure device), a developing device, and a cleaner, by placing the device in the same position according to the types of the devices with reference to the direction of gravity; and which enables highly-accurate mutual registration of the images.

Another object of the present invention is to provide an image forming method for use with this image forming apparatus.

To achieve this object, in accordance with a first aspect of the present invention, there is provided an image forming apparatus which forms a color image by the steps of forming a latent image, e.g., an electrostatic latent image, for each of colors, developing the latent image through use of each color toner to thereby produce a monochrome image for each color, superimposing the monochrome images on each other on predetermined paper, and fixing them, the apparatus comprising:

three or more rotary image carriers which have a cylindrical profile and are positioned so as to share a tangential plane in common, wherein latent images for respective monochrome images are each formed on the surface of the rotary image carriers while the rotary image carriers are in rotation, and the latent images are developed to thereby produce monochrome toner images through use of toner of respective colors; and one or a plurality of rotary transfer members which have a cylindrical profile and are positioned in contact with or in close proximity to the rotary image carriers, wherein the monochrome toner images formed on the rotary image carriers, which are in contact with or in close proximity to the rotary transfer members, are transferred to the surface of, or paper carried on, the rotary image carriers.

Preferably, the image forming apparatus further comprises a common support member for supporting the three or more rotary image carriers and one or the plurality of rotary transfer members.

More preferably, the image forming apparatus further comprises a common drive source for rotating the three or more rotary image carriers.

More preferably, either the rotary image carriers or the rotary transfer members have an elastic or resilient surface.

In accordance with a second aspect of the present invention, there is provided an image forming apparatus which forms a color image by the steps of forming a latent image, e.g., an electrostatic latent, image, for each of colors, developing the latent image through use of each color toner to thereby produce a monochrome image for each color, superimposing the monochrome images on each other on predetermined paper, and fixing them, the apparatus comprising:

a first constituent unit including one or more first rotary image carriers which have a cylindrical profile, wherein latent images for respective monochrome images are each formed on the surface of the rotary image carriers while the rotary image carriers are in rotation, and the latent images are developed through use of toner of respective colors; and a first rotary transfer member which has a cylindrical profile and is positioned in contact with or in close proximity to the rotary image carriers, wherein the monochrome toner images formed on the rotary image carriers, which are in contact with or in close proximity to the rotary transfer members, are transferred to the surface of, or paper carried on, the first rotary image carrier while it is in rotation; and a second constituent unit including one or more second rotary image carriers which have a cylindrical profile and rotary shafts in parallel with the rotary shafts of the first rotary image carriers and are positioned so as to be in reflectional symmetry with respect to the first rotary image carriers with reference to the plane of symmetry, wherein latent images for respective monochrome images are each formed on the surface of the second rotary image carriers while the second rotary image carriers are in rotation, and the latent images are developed to thereby produce monochrome toner images through use of toner of respective colors; and a second rotary transfer member which has a cylindrical profile and a rotary shaft in parallel with the rotary shafts of the first rotary transfer members and is positioned in contact with or in close proximity to the second rotary image carriers so as to be in reflectional symmetry with respect to the first rotary transfer member with reference to the plane of symmetry, wherein the monochrome toner images formed on the second rotary image carriers, which are in contact with or in close proximity to the second rotary transfer member, are transferred to the surface of, or paper carried on, the second rotary image carrier while it is in rotation.

Preferably, the toner image may be directly transferred to the surface of the first or second rotary transfer members, or the toner image may be transferred to the paper held on the surface of the first or second rotary transfer members. The toner image is not transferred to the paper held by each of the first and second rotary transfer members. Therefore, the toner image is directly transferred to at least either the first or second rotary transfer member, or the toner image is directly transferred to the surface of each of the first and second rotary transfer members. The image forming apparatus may be constructed in such a way that the toner image is transferred to the paper after having been transferred on the surface of each of the first and second rotary transfer members.

Preferably, the one or more rotary image carriers and the one or more second rotary image carriers are arranged so as to share a tangential plane in common.

Preferably, the first constituent unit comprises the two first rotary image carriers, and the second constituent unit comprises the two second rotary image carriers; and the first and second constituent units are arranged so as to be in reflectional symmetry with respect to the plane of symmetry.

Preferably, the image forming apparatus further comprises a common support for supporting the one or more first rotary image carriers, the first rotary transfer member, the one or more second rotary image carriers, and the second rotary transfer member in a rotatable manner.

Preferably, the image forming apparatus further comprises a first common support for supporting the one or more rotary image carries and the first rotary transfer member in a rotatable manner; and a second common support for supporting the one or more rotary image carriers and the second rotary transfer member in a rotatable manner.

Preferably, the first and second rotary transfer members are positioned so as to be in contact with or in proximity to each other and to rotate in opposite directions.

More preferably, the image forming apparatus further comprises a common drive source for rotating the one or more first rotary image carriers and the one or more second rotary image carriers.

More preferably, either the pair of one or more first and second rotary image carriers or the pair of first and second rotary transfer members have an elastic or resilient surface.

An image forming method for use with an image forming apparatus which forms a color image by the steps of forming a latent image, e.g., an electrostatic latent image, for each of colors, developing the latent image through use of each color toner to thereby produce a monochrome image for each color, superimposing the monochrome images on each other on predetermined paper, and fixing them; and which comprises a first constituent unit including one or more first rotary image carriers which have a cylindrical profile, wherein latent images for respective monochrome images are each formed on the surface of the rotary image carriers while the rotary image carriers are in rotation, and the latent images are developed through use of toner of respective colors; and a first rotary transfer member which has a cylindrical profile and is positioned in contact with or in close proximity to the rotary image carriers, wherein the monochrome toner images formed on the rotary image carriers, which are in contact with or in close proximity to the rotary transfer members, are transferred to the surface of, or paper carried on, the first rotary image carrier while it is in rotation; and a second constituent unit including one or more second rotary image carriers which have a cylindrical profile and rotary shafts in parallel with the rotary shafts of the first rotary image carriers and are positioned so as to be in reflectional symmetry with respect to the first rotary image carriers with reference to the plane of symmetry, wherein latent images for respective monochrome images are each formed on the surface of the second rotary image carriers while the second rotary image carriers are in rotation, and the latent images are developed to thereby produce monochrome toner images through use of toner of respective colors; and a second rotary transfer member which has a cylindrical profile and a rotary shaft in parallel with the rotary shafts of the first rotary transfer members and is positioned in contact with or in close proximity to the second rotary image carriers so as to be in reflectional symmetry with respect to the first rotary transfer member with reference to the plane of symmetry, wherein the monochrome toner images formed on the second rotary image carriers, which are in contact with or in close proximity to the second rotary transfer member, are transferred to the surface of, or paper carried on, the second rotary image carrier while it is in rotation, the method comprising:

a first step, in which a monochrome toner image is formed on the first rotary image carrier and is transferred to the first rotary transfer member, and another monochrome toner image is formed on the second rotary image carrier and is transferred to the second rotary transfer member;

a second step, in which either the toner image formed on the first rotary transfer member or the toner image formed on the second rotary transfer member is transferred to either the first or second rotary transfer member; and a third step of transferring the toner images on either the first or second rotary transfer member to the predetermined paper.

DETAILED DESCRIPTION OF THE PREFERRED EMBODIMENTS

Now, a description will be given in more detain of preferred embodiments of the present invention with reference to the accompanying drawings.

Figure 1:
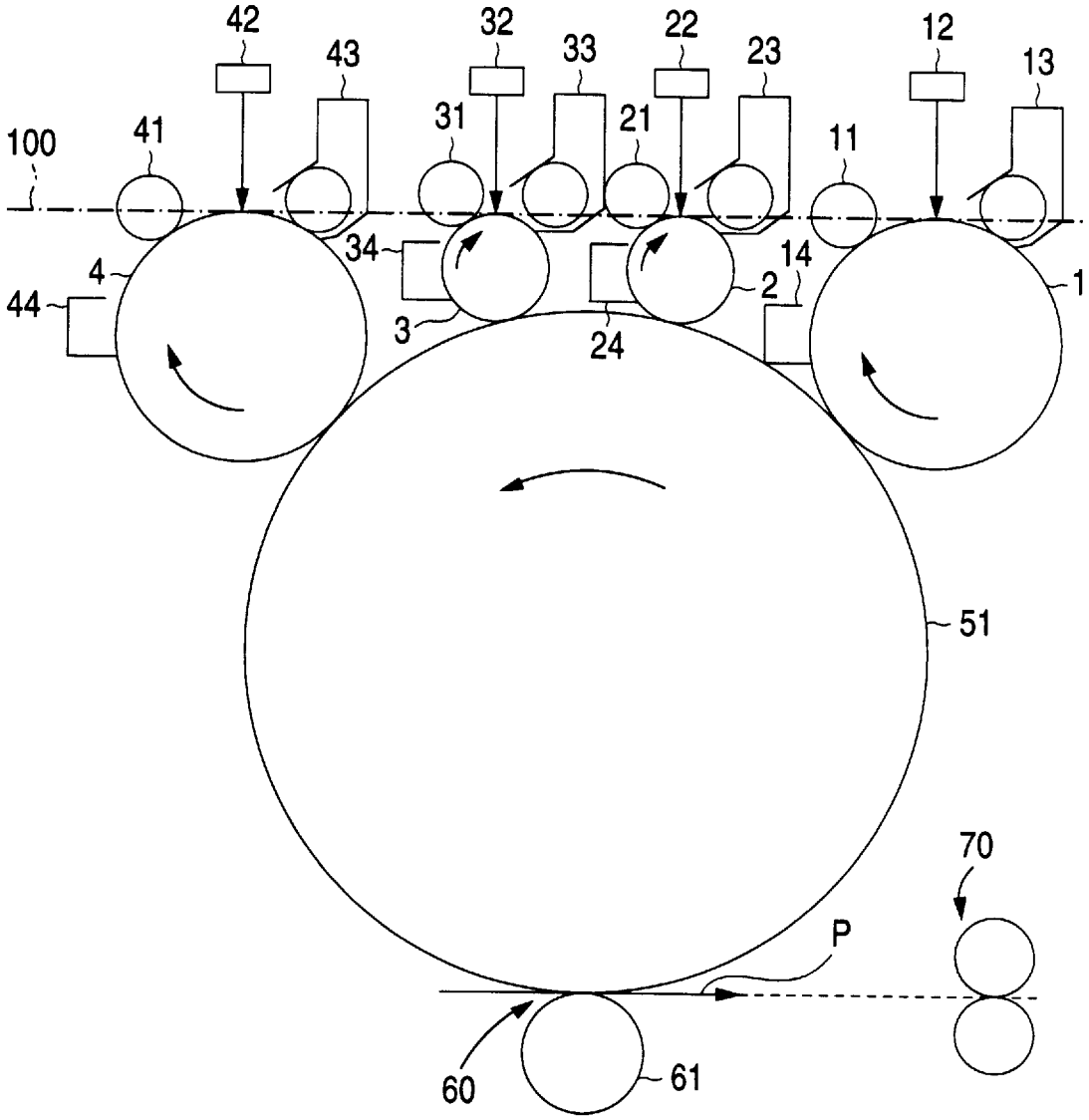
FIG. 1 is a side view of an image forming apparatus in accordance with a first embodiment of the present invention.

FIG. 1 is a side view of an image forming apparatus in accordance with a first embodiment of the present invention.

Photosensitive members 1, 2, 3, and 4 have a cylindrical profile and rotate in the direction designated by arrows. The photosensitive members 1, 2, 3, 4 are placed on a transfer intermediate member 51 in such a way as to share a tangential plane in common (the plane is represented as a common tangential plane 100 in the side view of FIG. 1, but may be often referred to as a tangential line in place of the tangential plane). This means that the charging devices 11, 21, 31, 41, the exposure devices 12, 22, 32, 42, the developing devices 13, 23, 33, 43, and the cleaners 14, 24, 34, 44 are placed in substantially the same position according to the type of the device with reference to the direction of gravity. FIG. 1 shows an example in which the photosensitive members 1, 2, 3, 4 are positioned on the intermediate transfer member 51. Even if they are placed in any positions such as on the right and left sides, in lower positions, or on the skew, it goes without saying that the commonality of the components placed around the four photosensitive members 1, 2, 3, 4 can be accomplished. The number of photosensitive members is not necessarily limited to four but may be more than three or five.

The intermediate transfer member 51 has a cylindrical profile and rotates in the direction designated by an arrow. Toner images formed on the respective photosensitive members 1, 2, 3, 4 are directly transferred to the surface of the intermediate transfer member 51 so as to be superimposed on each other in order. The toner images transferred to the intermediate transfer member 51 are further transferred to paper P conveyed to a predetermined secondary transfer position 60 by the action of a transfer roller 61 and are fixed by a fixing unit 70.

Figure 2:
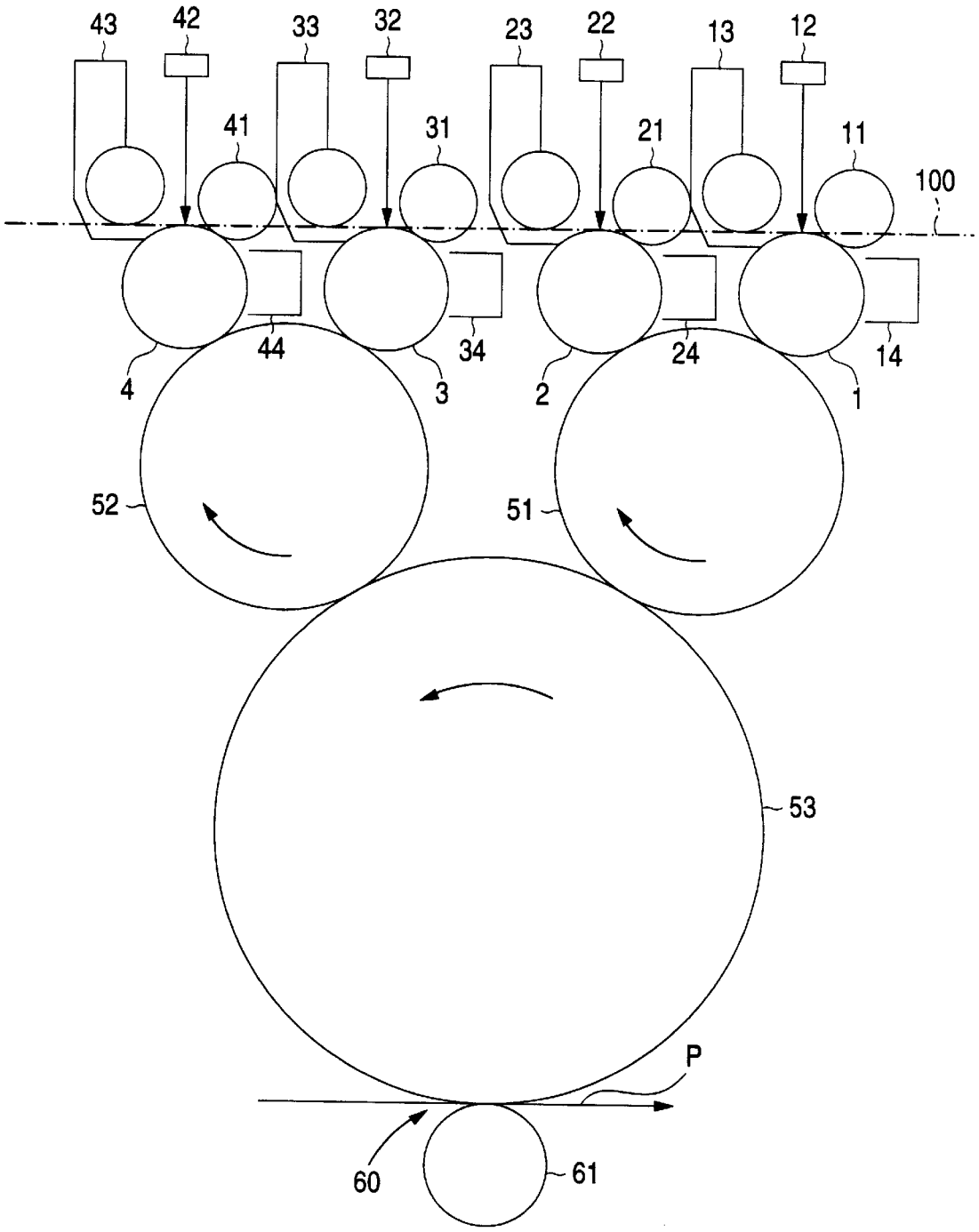
FIG. 2 is a side view of an image forming apparatus in accordance with a second embodiment of the invention.

FIG. 2 is a side view of an image forming apparatus in accordance with a second embodiment of the present invention. Elements other than the characteristic elements may be omitted from drawings to be described later.

The image forming apparatus in accordance with this embodiment shown in FIG. 2 has two constituent units, i.e., a unit comprised of the two photosensitive members 1, 2 and one intermediate transfer member 51, and another unit comprised of the two photosensitive members 3, 4 and one intermediate transfer member 52. The two intermediate transfer members 51, 52 are in contact with still another intermediate transfer member 53. The four photosensitive members 1, 2, 3, 4 share the tangential line 100 in common. Accordingly, the charging devices 11, 21, 31, 41, the exposure devices 12, 22, 32, 42, the developing devices 13, 23, 33, 43, and the cleaners 14, 24, 34, 44, all of which are situated around the respective photosensitive members 1, 2, 3, 4, are placed in substantially the same position with reference to the respective photosensitive members 1, 2, 3, 4. The commonality of the devices can be accomplished for each type.

Figure 21:
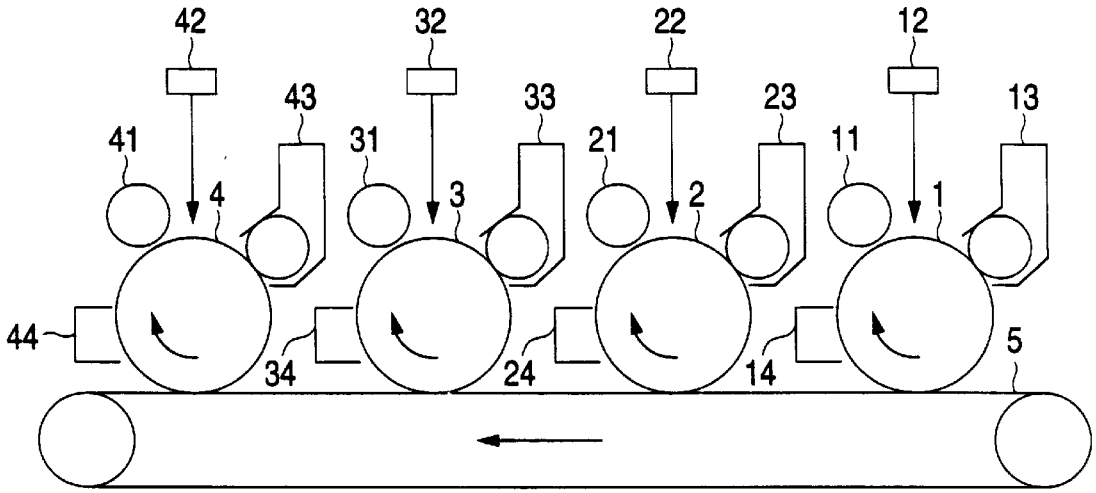
FIG. 21 PRIOR ART
FIG. 21 is a schematic representation showing one example of the construction of a frame in an existing image forming apparatus.

In the case of the second embodiment shown in FIG. 2, once having been transferred to the intermediate transfer member 51, the toner images formed on the respective photosensitive members 1, 2 are transferred to the intermediate transfer member 53. Similarly, once having been transferred to the intermediate transfer member 52, the toner images formed on the respective photosensitive members 3, 4 are transferred to the intermediate transfer member 53. The toner images transferred to the intermediate transfer member 53 are transferred to the paper P by one operation. The toner images transferred to the paper P are fixed by an unillustrated fixing device. The intermediate transfer members 51, 52, 53 are of a drum type and, hence, are less likely to cause the toner images to become offset. A belt-like intermediate transfer member may be employed for the intermediate transfer member 53 in place of a drum type intermediate transfer member. In this case, there is the risk of positional offsets occurring when the toner images transferred on the intermediate transfer member 51 and the toner images transferred on the intermediate transfer member 52 are directly transferred to the belt-like intermediate transfer member. Even in such a case, the positional offset occurred between the intermediate transfer members 51 and 52 can be reduced to sufficiently small tolerances in contrast to positional offsets occurred during the course of the travel of the paper over a long distance across the four photosensitive members 1, 2, 3, 4 such as those occurred in the example of the existing image forming member described with reference to FIG. 21.

Figure 3:
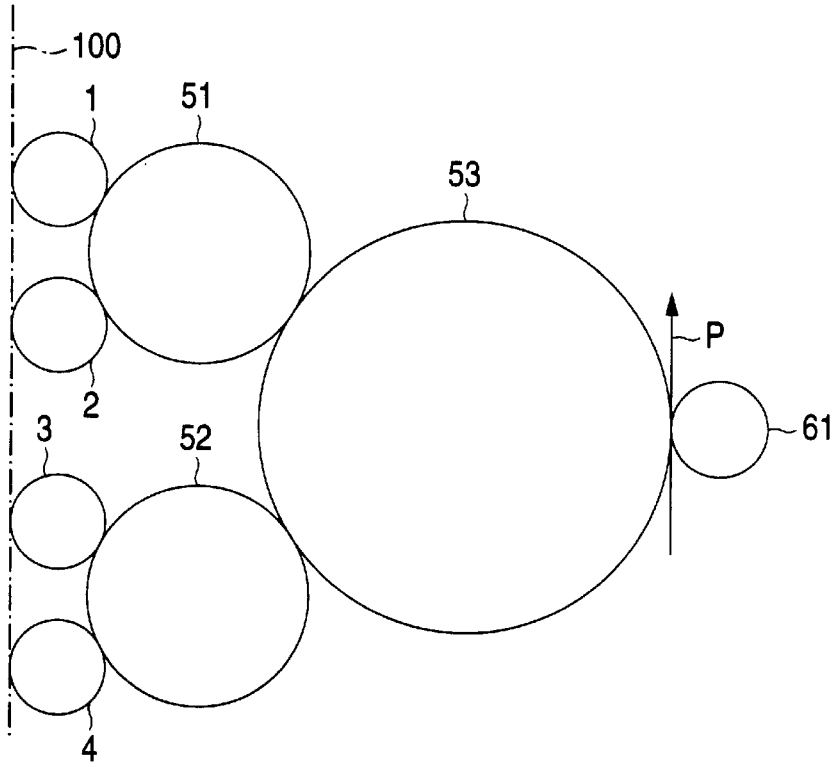
FIG. 3 is a schematic representation showing the principle construction of an image forming apparatus in accordance with a third embodiment of the present invention.

FIG. 3 is a schematic view showing the principal structure of an image forming apparatus in accordance with a third embodiment of the present invention.

The embodiment shown in FIG. 3 is an example similar to FIG. 2, but the arrangement of the components is rotated through 90 degrees. Specifically, the four photosensitive members 1, 2, 3, 4 are arranged so as to share the tangential line 100 in common in the longitudinal direction. Even when the four photosensitive members 1, 2, 3, 4 are arranged vertically, the charging devices, the exposure devices, the developing devices, and cleaners, all of which are disposed around the respective photosensitive members 1, 2, 3, 4, can be placed in the same positions with reference to the respective photosensitive members 1, 2, 3, 4 or gravity, thereby enabling the accomplishment of the commonality of the devices. FIG. 2 shows the example in which the common tangential line 100 extends horizontally, whereas FIG. 3 shows the example in which the common tangential line 100 extends vertically. Even if the photosensitive members 1, 2, 3, 4 are arranged so as to share an oblique tangential line in common, the commonality of the devices surrounding the respective photosensitive members can be accomplished.

Figure 4:
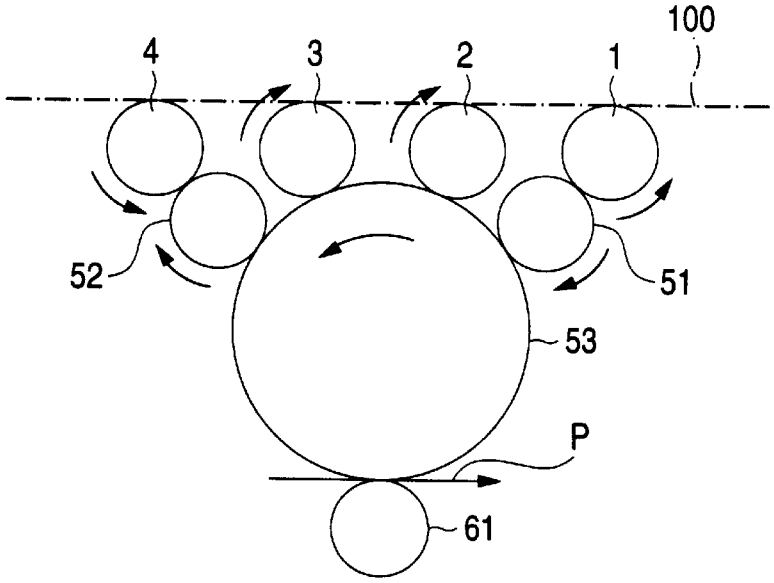
FIG. 4 is a schematic representation showing the principle construction of an image forming apparatus in accordance with a fourth embodiment of the present invention.

FIG. 4 is a schematic view showing the principal structure of an image forming apparatus in accordance with a fourth embodiment of the present invention.

This embodiment can be deemed as a modification of the first embodiment shown in FIG. 1 or of the second embodiment shown in FIG. 2. The toner images formed on the photosensitive members 1, 4 of the four photosensitive members 1, 2, 3, 4 are transferred to the respective intermediate transfer members 51, 52. The toner images are then transferred to the intermediate transfer member 53. In contrast, the toner images formed on the photosensitive members 2, 3 are directly transferred to the intermediate transfer member 53. Even in the fourth embodiment, the four photosensitive members share the common tangential line 100.

Figure 5:
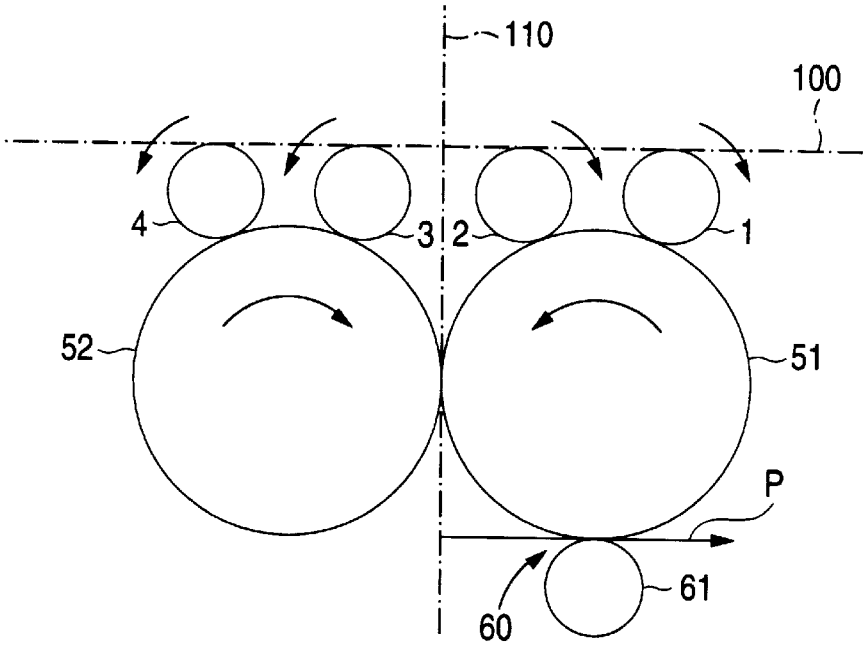
FIG. 5 is a schematic representation showing the principle construction of an image forming apparatus in accordance with a fifth embodiment of the present invention.

FIG. 5 is a schematic view showing the principal structure of an image forming apparatus in accordance with a fifth embodiment of the present invention.

In the fifth embodiment, the constituent unit comprised of the two photosensitive members 1, 2 and one intermediate transfer member 51 and the constituent unit comprised of the two photosensitive members 3, 4 and one intermediate transfer member 52 are arranged in such a way that the intermediate transfer members 51, 52 are in contact with each other.

The toner images formed on the intermediate transfer members 51, 52 are superimposed on each other by transferring the toner images from one intermediate transfer ember to another intermediate transfer member. In this case, the photosensitive members 1, 2 and the photosensitive members 3, 4 rotate in opposite directions. However, the photosensitive members 1, 2, 3, 4 are arranged so as to share the tangential line 100 in common. Further, the photosensitive members 1, 2, 3, 4 are arranged so as to be in reflectional symmetry (with respect to a line (in the lateral direction) in the side view shown in FIG. 5) with respect to a plane of symmetry (represented as a line of symmetry 110 in the side view in FIG. 5). Consequently, identical components can be used for the devices to be positioned around the respective four photosensitive members 1 through 4.

Figure 22:
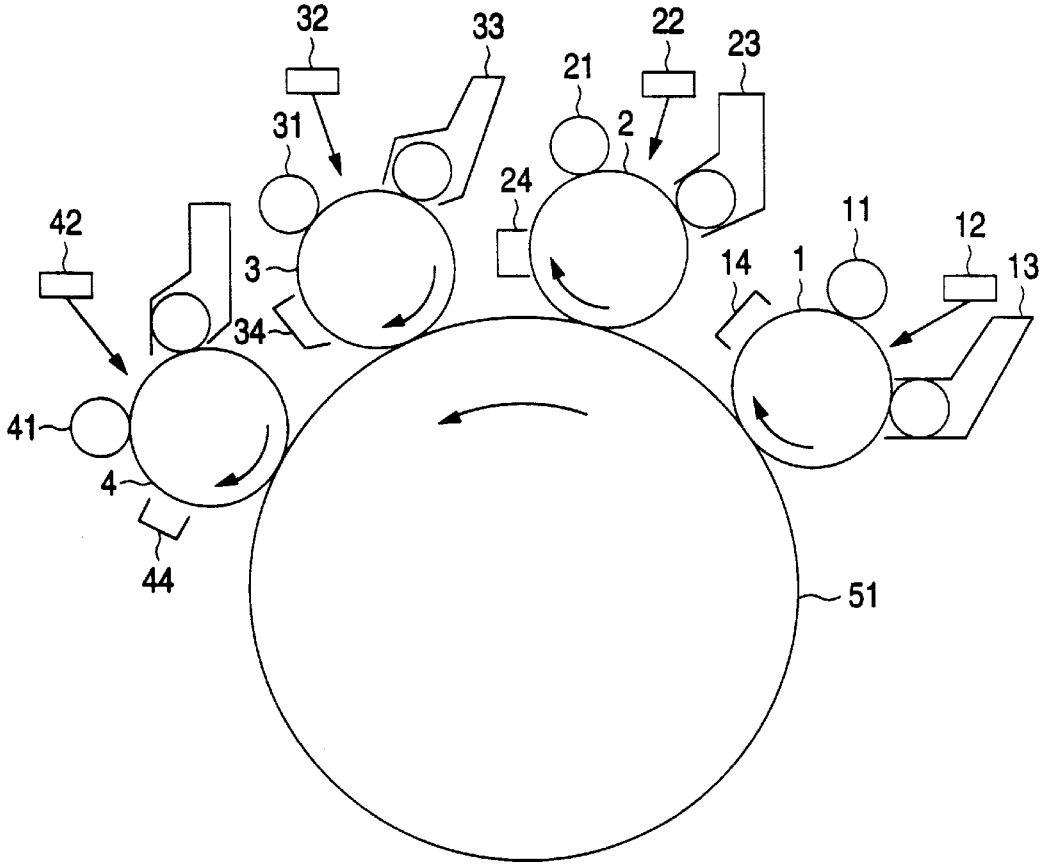
FIG. 22 PRIOR ART
FIG. 22 is a schematic representation showing another example of the construction of a frame in an existing image forming apparatus.

The configuration of this embodiment has another advantage. In the existing examples shown in FIGS. 21 and 22 and the embodiment shown in FIG. 1, latent images are each written on the four photosensitive members 1 through 4 at different timing. So called-gap memory is required to compensate for the difference in timing between the photosensitive members 1 and 2, 2 and 3, and 3 and 4. For the sake of clarity, assume that the difference in timing between the photosensitive members 1 and 2, 2 and 3, and 3 and 4 is equal, and the storage capacity of the gap memory required for compensation for the difference in timing is AM. The required storage capacity of the gap memory in the existing example 1ΔM for the difference in timing between the photosensitive members 1 and 2, 2ΔM for the difference in timing between the photosensitive members 1 and 3, and 3ΔM for the difference in timing between the photosensitive members 1 and 4. Gap memory having a total of 6ΔM of storage capacity becomes required. Similarly, gap memory having the storage capacity of ΔM is required for the difference in timing between the photosensitive members 1 and 2 as well as for the difference in timing between the photosensitive members 3 and 4. However, by virtue of the characteristics of symmetry, latent images can be written on the pair of photosensitive members 1 and 4 and the pair of photosensitive members 2 and 3 at completely the same timing. Therefore, the need for gap memory for compensation for the difference in timing between the pairs can be obviated. Gap memory having a total of 2ΔM of storage capacity is sufficient for compensation for the difference in timing between the photosensitive members, thereby resulting in cost reduction.

Figure 6:
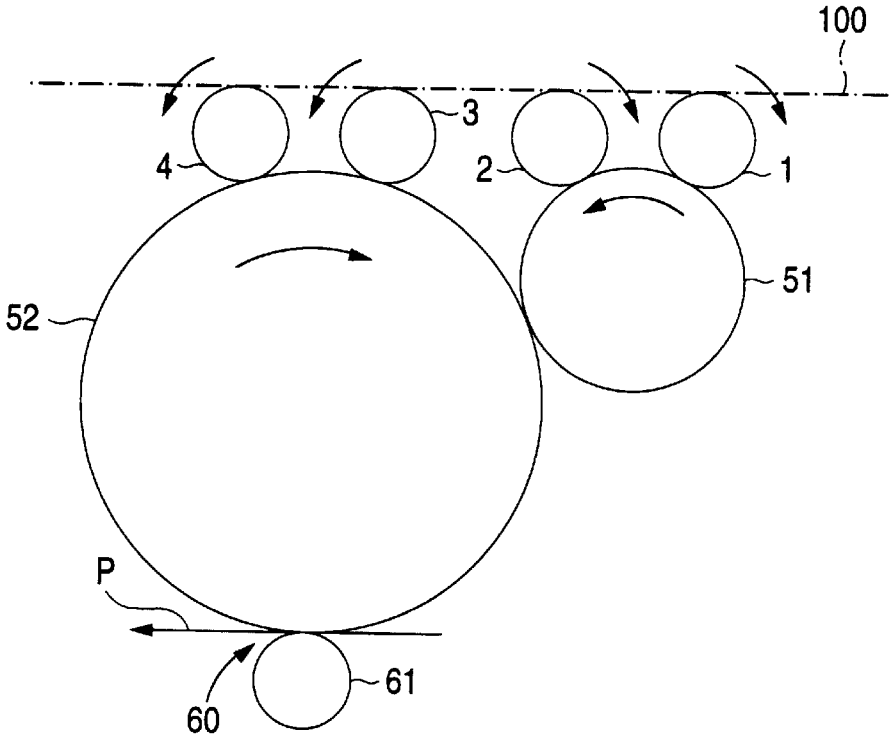
FIG. 6 is a schematic representation showing the principle construction of an image forming apparatus in accordance with a sixth embodiment of the present invention.

FIG. 6 is a schematic view showing the principal structure of an image forming apparatus in accordance with a sixth embodiment of the present invention and is a modification of the fifth embodiment shown in FIG. 5.

In this embodiment, the diameters of the two principle constituent members, i.e., the intermediate transfer members 51, 52, are changed while the four photosensitive members 1, 2, 3, 4 are arranged to have the tangential line 100 in common. In this way, in accordance with the present invention, the size of the intermediate transfer member can be comparatively freely determined in order to increase the degree of freedom of arrangement.

Figure 7:
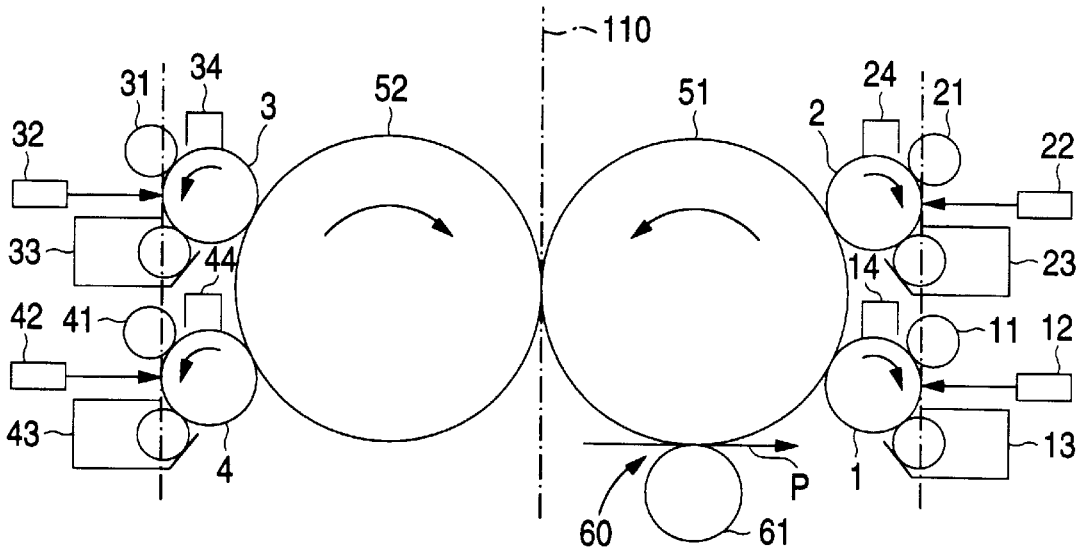
FIG. 7 is a schematic representation showing the principle construction of an image forming apparatus in accordance with a seventh embodiment of the present invention.

FIG. 7 is a schematic view showing the principal structure of an image forming apparatus in accordance with a seventh embodiment of the present invention.

As in the case of the fifth embodiment shown in FIG. 5, the embodiment shown in FIG. 7 has the constituent unit comprised of the two photosensitive members 1, 2 and one intermediate transfer member 51 and the constituent unit comprised of the two photosensitive members 3, 4 and one intermediate transfer member 52. In contrary to the fifth embodiment shown in FIG. 5, the four photosensitive members 1, 2, 3, 4 do not share a tangential line in common. In the seventh embodiment shown in FIG. 7, the two constituent units are arranged so as to be in reflectional symmetry with respect to the line of symmetry 110. As a result of the symmetrical layout, the commonality of the charging devices 11, 21, 31, 41, the exposure devices 12, 22, 32, 42, the photo-developing devices 13, 23, 33, 43, and the cleaners 14, 24, 34, 44, all of which are placed around the respective four photosensitive members 1, 2, 3, 4, can be accomplished according to the type of the device.

Although the four photosensitive members 1, 2, 3, 4 are shown in the seventh embodiment, the commonality of the devices can be accomplished even if any one of the photosensitive members of each of the constituent units is omitted.

Figure 8:
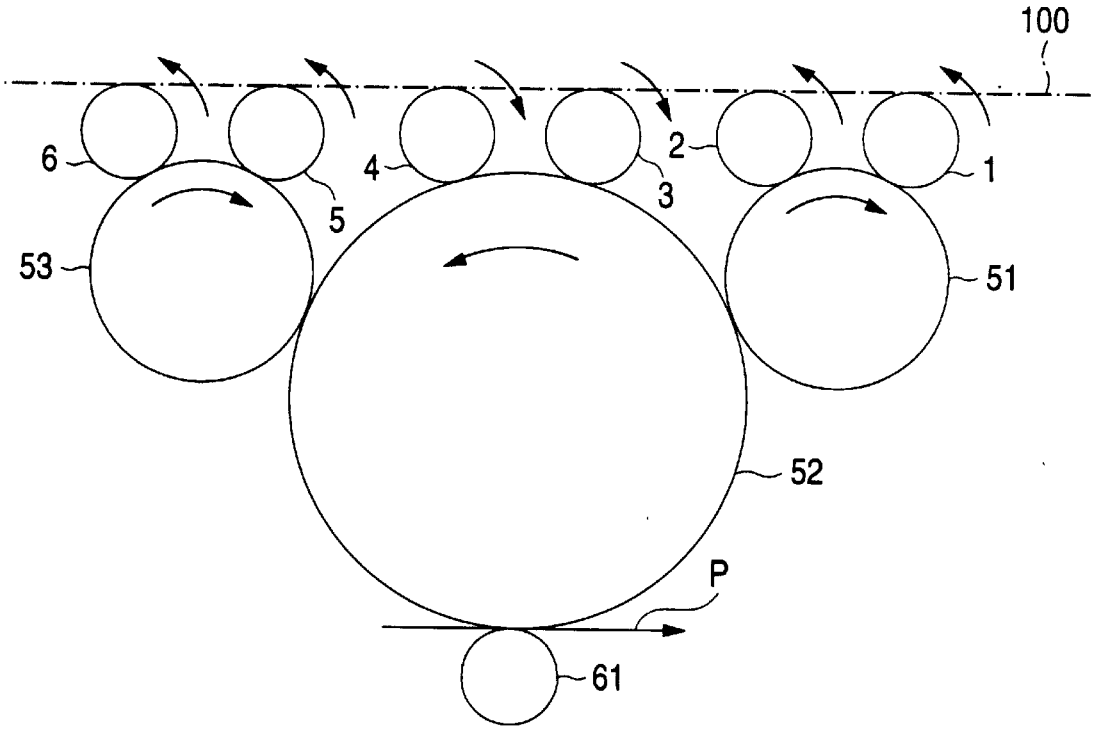
FIG. 8 is a schematic representation showing the principle construction of an image forming apparatus in accordance with an eight embodiment of the present invention.

FIG. 8 is a schematic view showing the principal structure of an image forming apparatus in accordance with an eighth embodiment of the present invention.

The drawing illustrates the principle configuration of the apparatus comprised of six photosensitive members 1 to 6 and three intermediate transfer members 51 to 53. Once having been transferred to the intermediate transfer members 51, 52, the toner images formed on the photosensitive members 1, 2 and 5, 6 are transferred to the intermediate transfer member 53. In contrast, the toner images formed on the photosensitive members 3, 4 are directly transferred to an intermediate transfer member 54.

Even in the eighth embodiment, the six photosensitive members 1 to 6 have the tangential line 100 in common. Accordingly, the commonality of the components is accomplished. In addition, since the intermediate transfer members of a drum type are employed, a high-quality color image which has very few positional offset between the toner images is formed.

Figure 9:
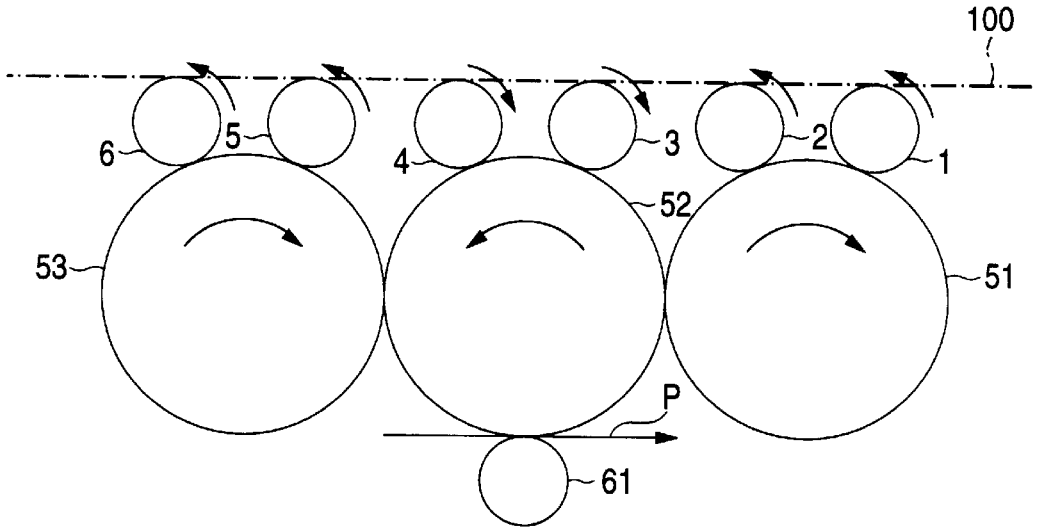
FIG. 9 is a schematic representation showing the principle construction of an image forming apparatus in accordance with a ninth embodiment of the present invention.

FIG. 9 is a schematic view showing the principal structure of an image forming apparatus in accordance with a ninth embodiment of the present invention.

The toner images formed on the photosensitive members 1 and 2, 3 and 4, and 5 and 6 are transferred to the respective intermediate transferred members 51, 52, and 53. The toner images transferred to the intermediate transfer members 51, 53 are transferred to the intermediate transfer member 52. In this way, after all the toner images have been transferred to the intermediate transfer member 52, they are transferred to the paper P.

Even in the ninth embodiment, the six photosensitive members 1 to 6 have the tangential line 100 in common. Accordingly, the commonality of the components is accomplished. In addition, since the intermediate transfer members 51, 52, 53 of the drum type are employed, a color image which has very few positional offset between the toner images is formed.

Figure 10:
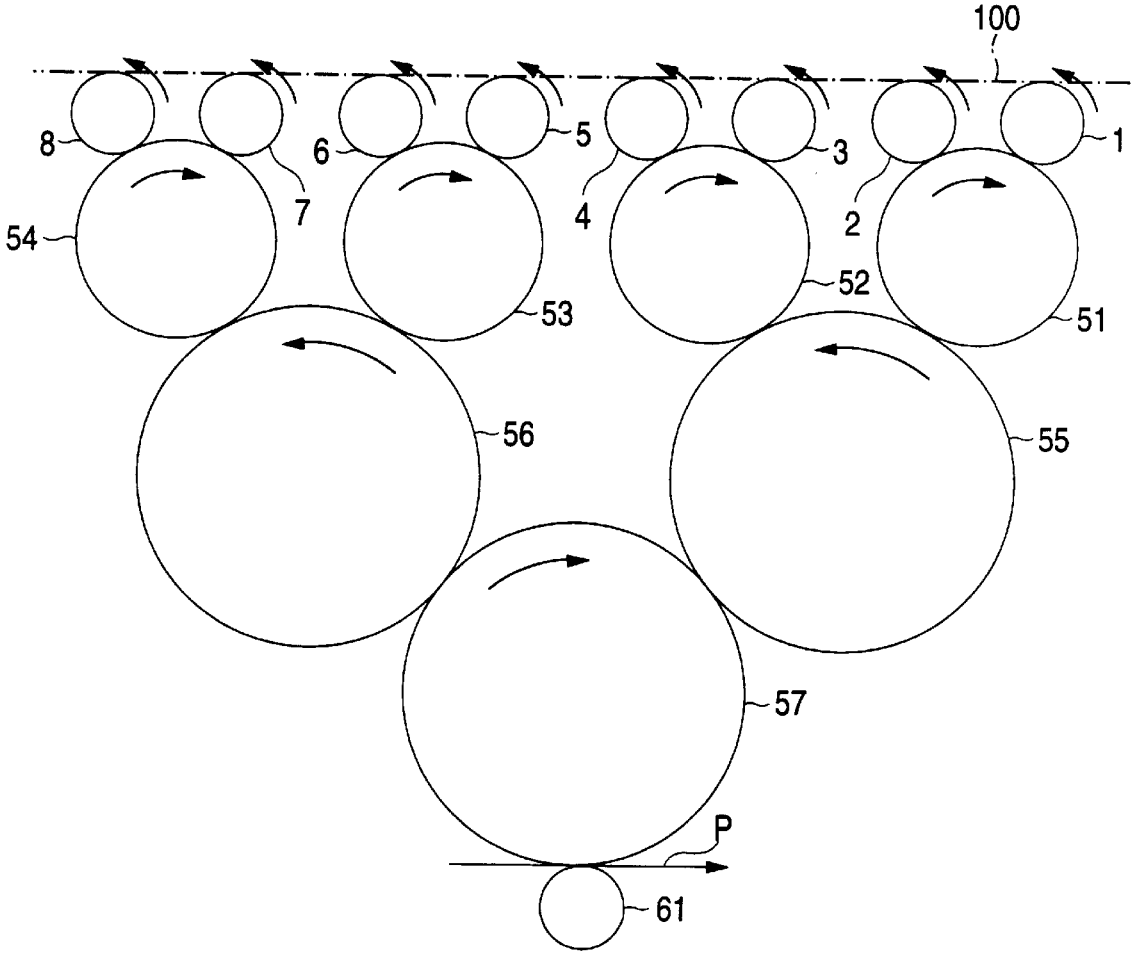
FIG. 10 is a schematic representation showing the principle construction of an image forming apparatus in accordance with a tenth embodiment of the present invention.

FIG. 10 is a schematic view showing the principal structure of an image forming apparatus in accordance with a tenth embodiment of the present invention.

In the tenth embodiment shown in the drawing, there are provided eight photosensitive members 1–8 having the tangential line 100 in common and seven intermediate transfer members 51 to 57. The operation of the apparatus is evident from the foregoing description, and hence the explanation of the operation of these elements will be omitted here.

As represented by the embodiments shown in FIGS. 8 to 10, the present invention can be applied to process color printing.

The registration of the toner images is now described. For example, in order to bring the toner images formed on the four photosensitive members 1 to 4 shown in FIG. 1 in register, various factors, e.g., the position where the photosensitive member is exposed to light, the timing at which a latent image is written, the surface velocity of the photosensitive member, or the surface velocity of the transfer member, must be correctly controlled. First, the plurality of photosensitive members must be rotated at the same surface velocity. To this end, it is desirable for the photosensitive members to receive torque from one drive source. More preferably, torque can also be imparted to the surface of the photosensitive members in order to eliminate the eccentricity of each of the photosensitive members or variations in the surface velocity of the photosensitive members due to a slight difference in diameter between the photosensitive members. In order to transmit torque to the surface of the photosensitive member, it is possible to employ either a method of transmitting torque to the photosensitive members from toque transmission rollers (see FIG. 13) or a method of transmitting torque to the photosensitive members while a belt or wire is completely wrapped around a part of the surface of each of the photosensitive members.

Figure 11:
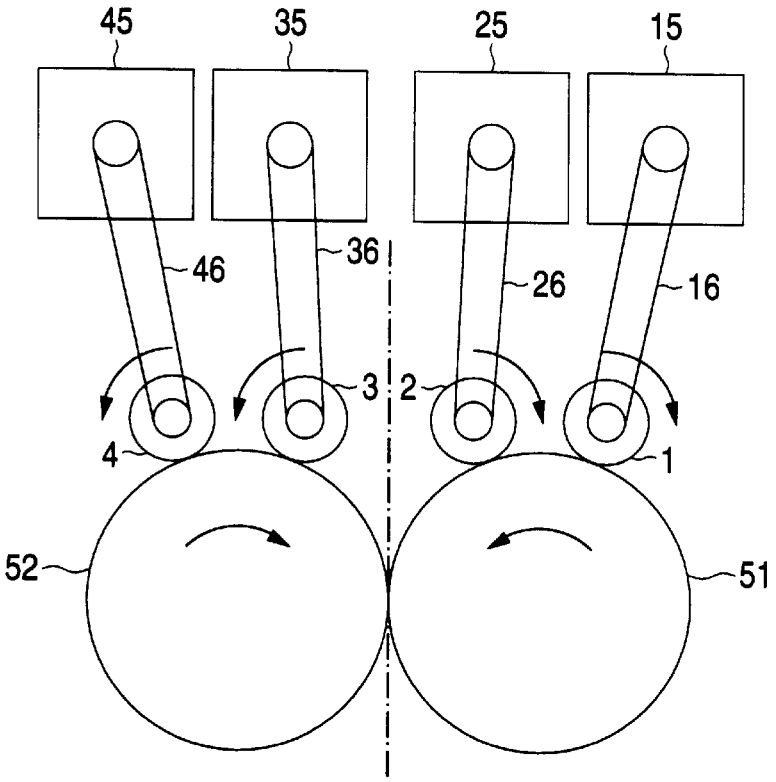
FIG. 11 is a schematic representation is a schematic representation showing a case where the image forming apparatus in accordance with the fifth embodiment shown in FIG. 5 employs an existing drive method.
Figure 12:
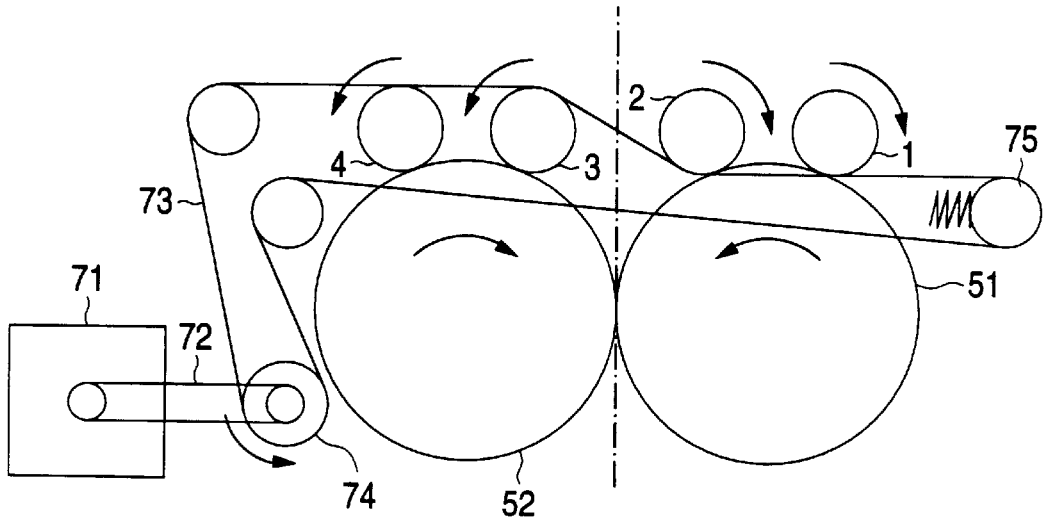
FIG. 12 is a schematic representation showing a case where the fifth embodiment shown in FIG. 5 employs a contrived drive method.
Figure 13:
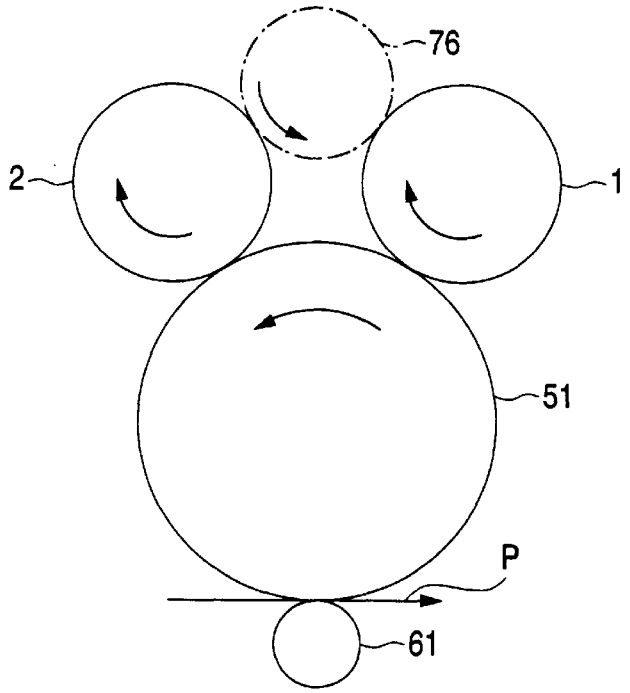
FIG. 13 is a schematic representation showing a case where the fifth embodiment shown in FIG. 5 employs another contrived drive method, wherein only one of the two constituent units is shown.

FIG. 11 is a schematic representation showing a case where the image forming apparatus in accordance with the fifth embodiment shown in FIG. 5 employs an existing drive method. FIG. 12 is a schematic representation showing a case where the fifth embodiment shown in FIG. 5 employs a contrived drive method. FIG. 13 is a schematic representation showing a case where the fifth embodiment shown in FIG. 5 employs another contrived drive method, wherein only one of the two constituent units is shown.

As shown in FIG. 11, according to the existing drive method, the photosensitive members are driven independently of each other by respective drive sources 15, 25, 35, 45 via drive belts 16, 26, 36, 46, or they are driven by one drive source via a plurality of torque transmission sources (e.g., gears). With such a drive method, the photosensitive members 1 to 4 experience slight variations in each of the torque transmission sources, so that they rotate at different surface velocities.

According to the drive method shown in FIG. 12, torque is transmitted from a single drive source 71 to a drive belt 73 wrapped around a roller 74 and a tension roller 75 via a drive belt 72. The drive belt 73 is brought into direct contact with or wrapped around the surface of the photosensitive members 1 to 4, whereby the photosensitive members 1 to 4 are driven by a frictional force (or a fastening force). The surface velocity of each of the photosensitive members 1 to 4 is constantly maintained at the same velocity.

According to the drive method shown in FIG. 13, the two photosensitive members 1, 2 are driven by one torque transmission roller 76. Although only one constituent unit is illustrated in this drawing, the four photosensitive members 1 to 4 can be rotated at the same surface velocity by maintaining, at the same rotational speed, two torque transmission rollers for driving the pair of photosensitive members 1, 2 and the pair of photosensitive members 3, 4 of the respective two constituent units in accordance with the fifth embodiment shown in FIG. 5 by, e.g., the drive method shown in FIG. 12.

Regardless of the surface velocity of each of the photosensitive members 1 to 4, it is desirable to independently control the surface velocity of each of the intermediate transfer members 51, 52 at the positions where the photosensitive members 1 to 4 come into contact with the intermediate transfer members 51, 52. In this case, it is essential to stably maintain the distance between the rotary shafts of the respective photosensitive members 1 to 4 and the rotary shafts of the respective intermediate transfer members 51, 52. To this end, the positions of members supporting the respective photosensitive members and of members supporting the respective rotary transfer members must be controlled with an extremely high degree of accuracy. In order to readily effect this control, it is desirable to uniformly produce each of the supporting members. The rotary shafts of the photosensitive members 1 to 4 are arranged to as to be in parallel with the rotary shafts of the intermediate transfer members. However, if this positional relationship is not determined in conformity with specifications, or if the rotary shafts are dislocated while they are in use or are removed from or attached to the image forming apparatus, the toner images on the intermediate transfer members will be sent in an oblique direction with respect to the direction in which the photosensitive members 1 to 4 are arranged. As a result, chromatic displacement will arise chiefly in the direction of primary scanning when the toner images are superimposed on each other.

Figure 14:
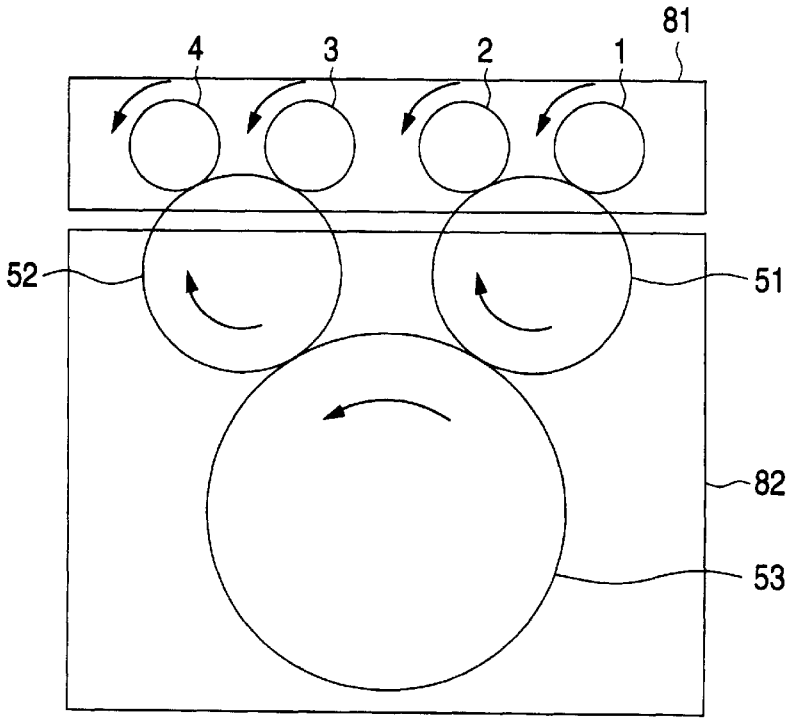
FIG. 14 is a schematic representation showing an example of the construction of a frame in accordance with the second embodiment shown in FIG. 2.
Figure 15:
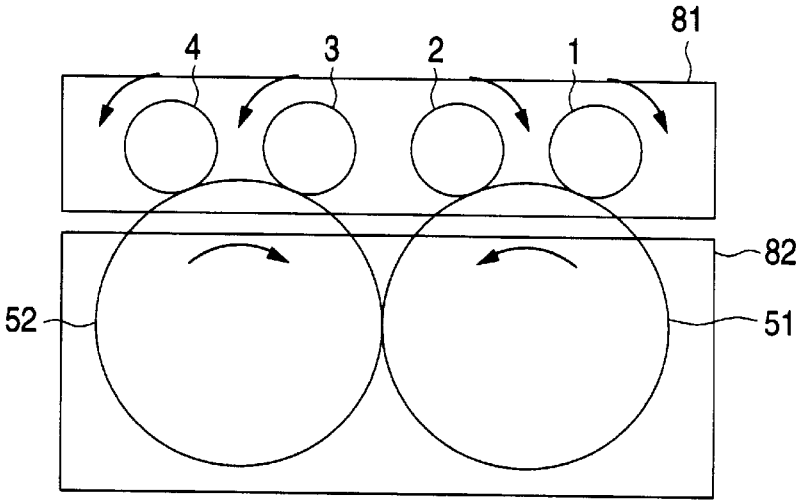
FIG. 15 is a schematic representation showing an example of the construction of a frame in accordance with the fifth embodiment shown in FIG. 5.

FIGS. 14 and 15 are schematic representations showing examples of the construction of frames used in the respective second and fifth embodiments shown in FIGS. 2 and 5.

The four photosensitive members 1 to 4 are supported in a rotatable manner by a common frame 81. The two or three intermediate transfer members 51, 52, (53) are supported in a rotatable manner by another frame 82 which is different from the frame 81. With this layout, the photosensitive members 1 to 4 and the intermediate transfer members 51, 52, (53) are less likely to become offset from each other. However, the group of photosensitive members is apt to become offset from the group of intermediate transfer members. To prevent such an offset, it is necessary to additionally provide a complicated mechanism for adjusting the alignment between the photosensitive members and the intermediate transfer members or a mechanism for mutually controlling the positions of the frames.

Figure 16:
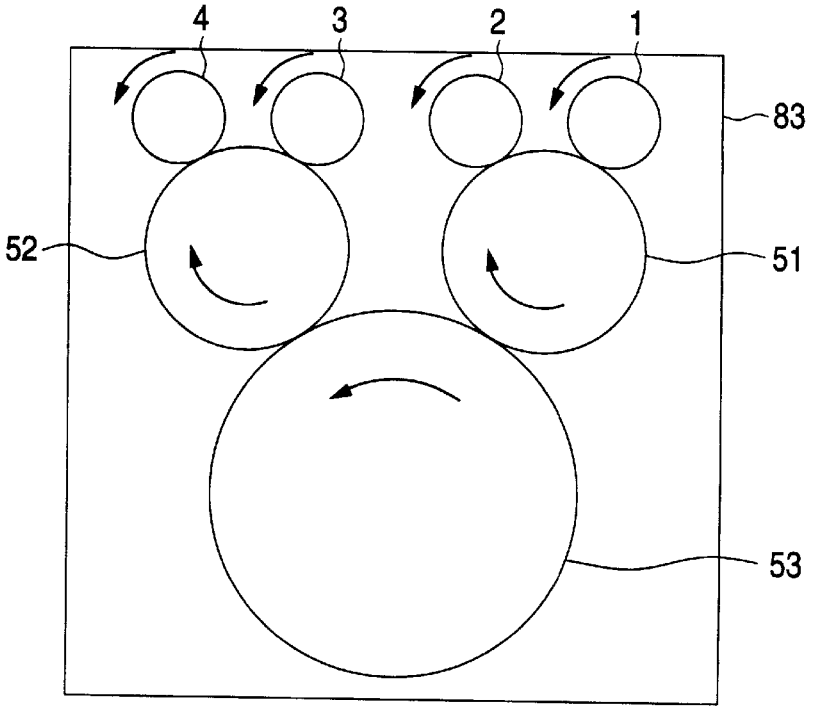
FIG. 16 is a schematic representation showing another example of the construction of a frame in accordance with the second embodiment shown in FIG. 2.
Figure 17A:
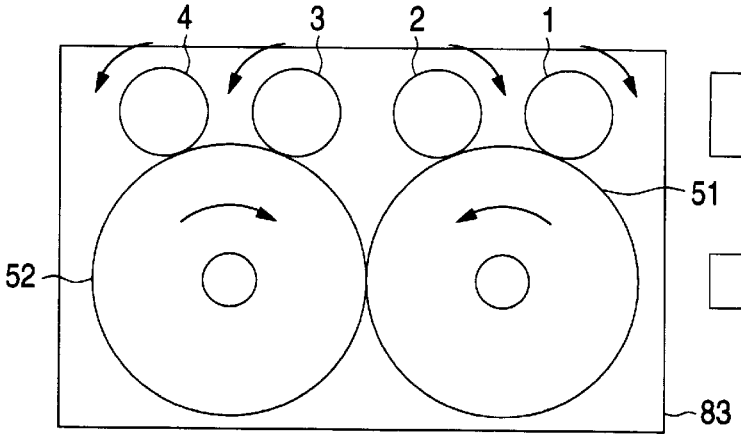
FIGS. 17A and 17B are a side view and a plan view showing another example of the construction of a frame in accordance with the fifth embodiment shown in FIG. 5.
Figure 17B:
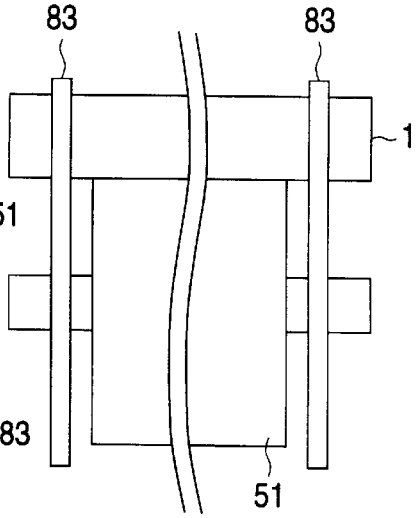

FIGS. 16 and 17A, 17B are schematic representations showing other examples of the construction of the frames used in the respective second and fifth embodiments shown in FIGS. 2 and 5. FIGS. 17A and 17B are a side view and a plan view from which the center portion of the frame is omitted, respectively.

In the examples of the construction of the frames, the four photosensitive members 1 to 4 and the two or three intermediate transfer members 51, 52, (53) are all supported by a single frame 83 in a rotatable manner. With this supporting system, the initial position control or the adjustment required after the replacement of a unit including the overall components supported by the frame 83 becomes unnecessary or facilitated very much.

Figure 18:
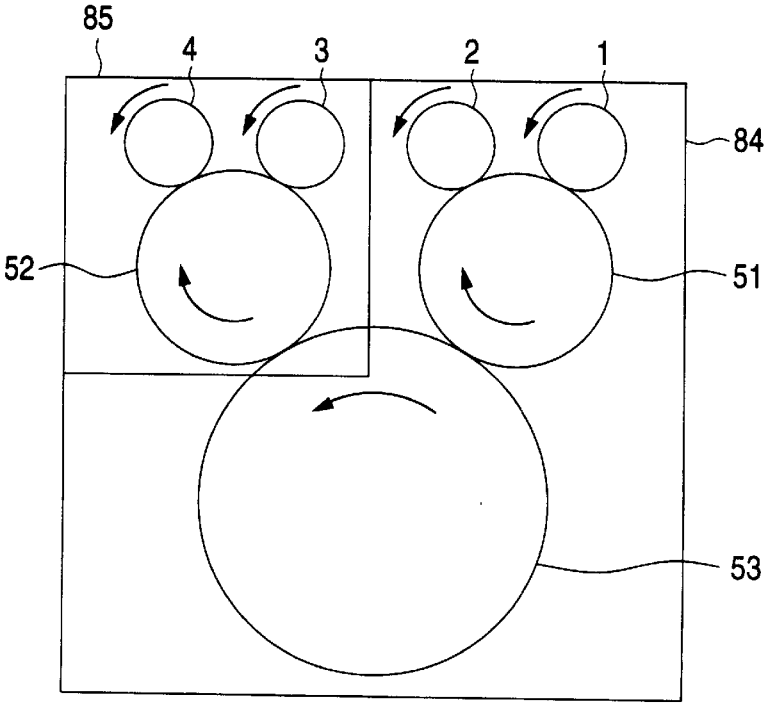
FIG. 18 is a schematic representation showing a still another example of the construction of a frame in accordance with the second embodiment shown in FIG. 2.
Figure 19:
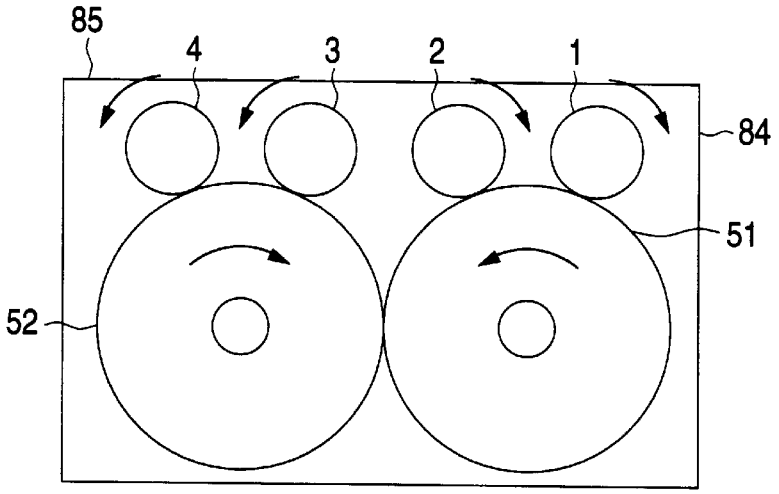
FIG. 19 is a schematic representation showing a still another example of the construction of a frame in accordance with the fifth embodiment shown in FIG. 5.

FIGS. 18 and 19 are schematic representations showing further different examples of the construction of the frames used in the respective second and fifth embodiments shown in FIGS. 2 and 5.

The photosensitive members 1, 2 and the rotary transfer member(s) 51, (53) are supported by one frame 84. The photosensitive members 3, 4 and the intermediate transfer member 52 are supported another frame 85. In the case where the image forming apparatus is assembled so as to allow the integration of separated units, if the principle unit which is comprised of the photosensitive members 1, 2 and the rotary transfer member(s) 51, (53) and acts as a two-color printer can be immediately changed to a full-color printer by addition of another element, i.e., the constituent element comprised of the photosensitive members 3, 4 and the intermediate transfer member 52.

Moreover, it is necessary to absorb the difference in surface velocity between the photosensitive members and the intermediate transfer member, both of which are supported with a high degree of accuracy, by causing slippages between them at the positions where they come into with each other. Further, sufficient amounts of rigidity and torque which allow the rotation of the rotary members by absorption of the eccentricity of the rotary members are also needed. To these ends, preferably, at least either the photosensitive members or the intermediate transfer members must be produced so as to have a surface formed from an elastic material or to comprise a rigid member coated with an elastic surface. Alternatively, the members may be formed into so-called rubber rollers or endless belts extended in a cylindrical pattern. More preferably, the coefficient of friction of the contact surfaces of the members is 3 or less. For this reason, in the case of the rubber roller, a layer containing, e.g., a fluorine-based lubricant, may be formed on the surface of the rubber roller, or fine particles are interposed as a lubricant between the members.

The foregoing description also applies to the relationship between the intermediate transfer members 51, 52, 53 shown in FIG. 2.

Figure 20:
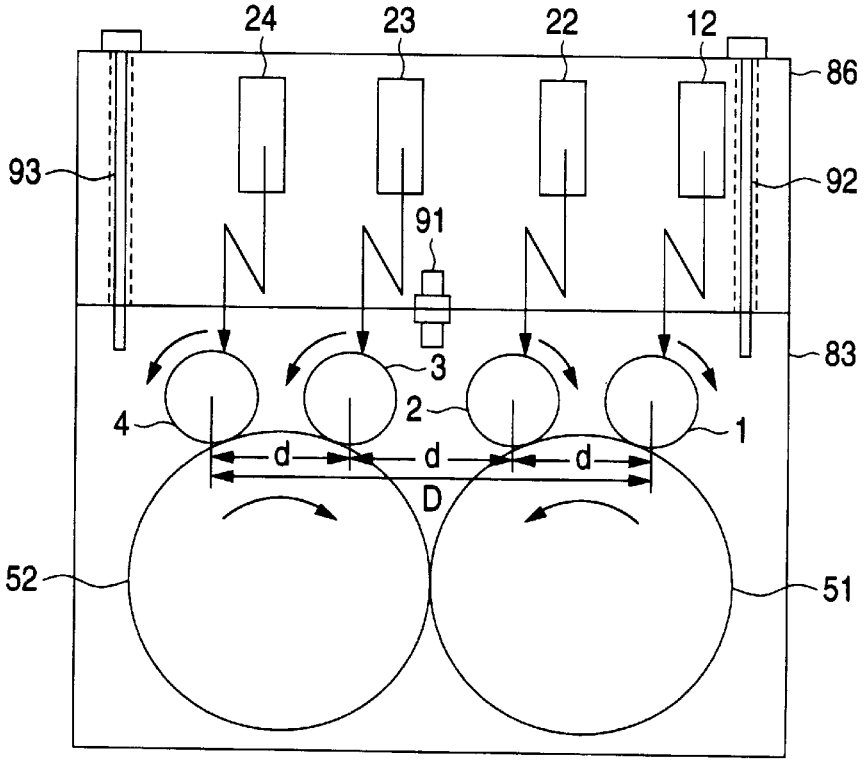
FIG. 20 is a schematic representation showing the example of the construction of a frame in accordance with the fifth embodiment shown in FIG. 5.

FIG. 20 shows an example of the construction of the frame employed in the fifth embodiment shown in FIG. 5.

The four photosensitive members 1 to 4 and the two intermediate transfer members 51, 52 are supported by the frame 83 in a rotatable manner. The exposure devices 12, 22, 32, 42 corresponding to the respective photosensitive members 1 to 4 are supported by another frame 86 which is different from the frame 83.

The two frames 83, 86 are fastened to each other by a fixture 91 provided in the longitudinal center of each of the frames 83, 86. Fixtures 92, 93 provided on both longitudinal ends of the frames are loosely fastened so as to have tolerances which permit the difference between the frames 83 and 86 due to the difference in coefficient of thermal expansion between them.

As shown in FIG. 20, in a case where an electrophotographic processing unit including the photosensitive members is provided on a frame which is different from a frame on which a scanning exposure unit is provided, and where these frames are joined together, it is desirable to fasten the areas in the vicinity of the center of the frames in the direction in which the scanning exposure devices and the photosensitive members are arranged. If the areas in the vicinity of the center of the frames are fastened to each other, chromatic displacement occurred in the direction of primary scanning (i.e., in the direction perpendicular to the plane of the drawing sheet of FIG. 20) due to temperature variations after the frames have been initially fixed or adjusted to eliminate chromatic displacement will be canceled between the first and fourth color photosensitive members and between the second and third color photosensitive members. However, there still remain chromatic displacement between the first and second color photosensitive members, the third and fourth color photosensitive members, the first and third color photosensitive members, and the second and fourth color photosensitive members. The basic dimension for thermal expansion is defined not as D between the furthermost photosensitive members but as a distance "d" between the adjacent photosensitive members. Therefore, the four types of chromatic displacement occur only within the respective distances "d." As a result, the extent to which the chromatic displacement occurs is reduced to about ⅓ the extent of chromatic displacement occurred in the case shown in FIG. 21. In contrast, in a case where the electrophotographic processing unit is securely fastened to the areas of the scanning exposure device outside the first or fourth color photosensitive member or to the positions of the fixtures 92 and 93, the chromatic displacement between, e.g., the first and fourth color photosensitive members, appears in the distance D (or the basic dimension) between the first and fourth color photosensitive members. Accordingly, temperature variations cause the chromatic displacement which is substantially the same in size as the chromatic displacement occurred in the image forming apparatus having the existing layout.

Following the description about the outline of the present invention, a more preferred embodiment of the image forming apparatus will now be described hereinbelow.

It has been mentioned that the use of a rotary member as the intermediate transfer member is particularly advantageous to registration of the toner images. However, attention must be given to the size of the rotary member; namely, to the relationship between the size of the photosensitive member and the size of the intermediate transfer member. The size of the photosensitive member used herein includes the overall size of the photosensitive member which includes the functional components provided around it (i.e., the charging device, the exposure device, the developing device, and the cleaner). In a case where the intermediate transfer member is of a belt type, even if the size of the photosensitive member is increased, solely the length of the belt will be extended, so that the size of the belt drive device in the thicknesswise direction remains constant. In other words, the belt is extended in a one-dimensional manner. In contrast, in a case where the intermediate transfer member is of a drum type, if the size of the photosensitive member is increased, the circumferential length of the drum-shaped intermediate transfer member will also be increased. Therefore, the area occupied by the intermediate transfer member is increased in a two-dimensional manner. In short, if the size of the photosensitive member is small, a drum-type member will be advantageous in terms of size. Conversely, if the size of the photosensitive member is increased, a belt-type member will become advantageous. More specifically, if the size of the photosensitive member becomes smaller than 60 mm, the advantageous effect of the present invention will be heightened by the adoption of a drum-type intermediate transfer member.

In this sense, the present invention is congenial to a method whose image forming processes are simple. For example, a laser scanning exposure device which does not need large space in the vicinity of the photosensitive member is desirable as the exposure device. A method which does not use any cleaners is particularly desirable for the present invention. For example, in the second embodiment shown in FIG. 2, if cleaners are provided for each of the photosensitive members 1 to 4 and the intermediate transfer members 51, 52, 53, a total of seven cleaners will be needed. If all the cleaners or one/two of them can be reduced, the present invention will produce considerable effects in terms of the size of the overall image forming apparatus.

As means for reducing the number of cleaners, there is means for creating a toner image by applying fine particles on the photosensitive member and the intermediate transfer member in advance, and carrying out photo-developing and transferring operations. At this time, the surface of the photosensitive member is put in such a condition as to have at least one fine particle, preferably more than two fine particles, per about 10 square micrometers. Accordingly, a toner image formed by the photo-development and transfer is reliably placed on the fine particles, thereby ensuring space between the toner image and the photosensitive member and the intermediate transfer member. As a result, the transfer of the toner image to the next step is facilitated.

In addition, it is effective to use the foregoing means together with another conventionally-known method of reducing the adhesion of the toner image; e.g., a method of imparting an additive to the toner stored in the developing device, a method of processing toner in a spherical form, a method of coating the surface of photosensitive members or intermediate transfer members with material having a low-surface energy, or a method of roughening the surface of photosensitive members or intermediate transfer members by creating minute irregularities on the surface.

Fine particles may stick to or be mixed with a toner image, so that they are transferred together with the toner image. It is essential to prevent a toner image from becoming jumbled or to prevent an irregular color pattern or the missing of color from arising in a toner image. Further, in view of this point, at least fine particles which are smaller in particle size than toner particles are used. In consideration of the reproducibility of a fine line or a dot, much smaller fine particles are preferable, and hence it is desirable to use fine particles having a particle size of less than 5 $\mu$m.

Material for the fine particles includes, e.g., inorganic fine powders such as titanium oxide, alumina, silica, barium titanate, calcium titanate, strontium titanate, zinc oxide, magnesium oxide, zirconium oxide, barium sulfate, barium carbonate, silicon carbide, silicon nitride, chromium oxide, or red oxide; or organic fine powders such as polyacrylate, polymetacrylate, polymethylmethacrylate, polyethylene, polypropylene, polyvinylidene fluoride, or polytetrafluoroethylene.

One or a plurality of types of fine particles may be simultaneously present on the photosensitive members or intermediate transfer members. The number of types of fine particles can be arbitrarily determined, so long as the fine particles interposed between the toner image and the photosensitive members or the intermediate transfer members contribute to a reduction in the adhesion between the toner image and the photosensitive members or the intermediate transfer members.

In this way, the system which has an improved transfer rate and from which cleaners are omitted allows cleaning of residual toner through use of the developing device (or by use of the developing device also as the cleaner). It is also possible to arrange a development bias in such a way that substantially the most of toner used for development is transferred to the photosensitive member without collecting residual toner through use of the developing device.

Although the intermediate transfer member has been described as a member on which a toner image is directly transferred, the present invention can also be applied to an image forming apparatus in which paper is held on the surface of the intermediate transfer member, and a toner image is transferred to the paper.

Although the explanation has been given of the operation of the image forming apparatus which employs the electrophotographic recording method based on a Carlson process, the present invention can also be applied to a charge-less or back exposure method. The present invention is also effective for a so-called electrostatic recording method, an ionography method, or a method in which an electrostatic latent image is directly written on dielectric substances instead of on photosensitive members and transfers the image to paper after having developed it.

Examples of the present invention will be described hereinbelow.

(EXAMPLE 1)

The outline of test equipment is as shown in FIG. 5. Tests were performed through use of one of two units (each unit comprising two photosensitive members and one intermediate transfer member) shown in FIG. 5. The details of test conditions are as follows:

(Test Conditions)

Photosensitive Member: OPC (ϕ30)

Distance between the centers of the photosensitive members: 50 mm

ROS: Laser 780 nm

Development method: Non-magnetic one component development

Cleaning: Blade cleaning method

Intermediate transfer member: A metal roller on which a conductive silicon rubber layer (having a coefficient of friction of 4) is formed to a thickness of 1 mm, fine particles of titanium oxide provided on the surface of the silicon rubber layer (the coefficient of friction of the intermediate transfer member obtained after the fine particles have been applied to the silicon rubber layer is 0.7), and the outer diameter of roller is ϕ100

Processing rate: 100 mm/s

Electric potential of a latent image: Background=−600 V, Image area=−150V

Development roller: Sleeve diameter=ϕ18 Rotational speed of the sleeve=150 mm/s

Development bias: DC component=−500 V AC component=1.5 kvp-p (6 kHz)

Transfer condition: Intermediate transfer roller=+500V Bias roller=+1000V (for secondary transfer)

Toner: Polyester+silica 0.8 wt. %

The tests were performed while the fine particles were adhered to the photosensitive members. Fine particles of polymethylmethacrylate having a mean particle size of 40 nm were used as the fine particles to be adhered to the photosensitive members. The fine particles were manually adhered to the photosensitive members.

A very compact tandem engine comprising one of the two constituent units shown in FIG. 5 was manufactured under the foregoing conditions through use of common members to be provided around the photosensitive members. A two-color image was produced without controlling the position of the image besides adjustments for initial setup. Subsequently, the amount of positional dislocation of the image was measured over the entire area of A4-size transfer paper, and a mean value of 55 microns was obtained. This value is sufficiently acceptable in comparison with a dislocation of 300 to 400 microns obtained through use of a belt-like transfer member without controlling the position of the image.

(SECOND EXAMPLE)

All cleaners were removed from the test apparatus used in the example 1 by modification. As a result, a marginal space was created around the photosensitive member, and the distance between the photosensitive members could be reduced from 50 mm to 40 mm, thereby rendering the apparatus more compact. DC components of the development bias were changed to −450V in order to enable removal of the residual toner in tandem with development. Further, toner was changed to spherical toner manufactured by wet processes. The composition of the toner is substantially the same as that of the toner before it was changed.

A two-color image was produced with one of the constituent units shown in FIG. 5 under the foregoing test conditions through use of the common members to be provided around the photosensitive members without controlling the position of the image besides initial setup. Subsequently, the amount of positional dislocation of the image was measured over the overall area of the A4-size paper. As a result, a mean value of 47 microns which is satisfactory was obtained. In comparison with the example 1, better test results were obtained by virtue of the reduction in the size of the image forming apparatus. At this time, a superior-quality image without a residual image was obtained without use of cleaners.

(EXAMPLE 3)

The image forming apparatus was built through use of the two constituent units employed in the second embodiment, namely, the image forming apparatus was built in the structure as shown in FIG. 5. The same tests were conducted by use of this apparatus. Four color toner images were finally superimposed on the intermediate transfer member 51, and the toner images were transferred to paper P through use of a bias roller 61. Modifications to the apparatus in accordance with the second embodiment are as follows:

The bias voltage was changed in order to transfer a toner image from the intermediate transfer member 52 to the intermediate transfer member 51. Conditions for the photosensitive members 1, 2 and the intermediate transfer member 51 were the same as those for the corresponding members in the second embodiment. The bias voltage applied to the photosensitive members 3, 4 and the intermediate transfer member 52 was increased from the bias voltage applied to the photosensitive members 1, 2 and the intermediate transfer member 51 by 500 V. In short, a bias voltage of −500 V was applied to each of the base members of the photosensitive members 3, 4, and a bias voltage of 0 was applied to the base member of the intermediate transfer member 52.

A four-color image was produced with the construction shown in FIG. 5 under the foregoing test conditions through use of the common members to be provided around the photosensitive members without controlling the position of the image besides initial setup. Subsequently, the amount of positional dislocation of the image was measured over the overall area of the A4-size paper. As a result, a mean value of 78 microns which is satisfactory was obtained. At this time, a residual image was not observed on the cleaner, and superior picture quality was obtained. A transfer rate was 99%. In comparison with a value of 500 to 600 microns obtained through use of a transfer belt as an intermediate transfer member without controlling the position of the image, the mean value presented a very superior effect.

(EXAMPLE 4)

Next, the effect obtained as a result of integral supporting of the constituent units shown in FIG. 5 was acknowledged. More specifically, bearings for supporting the respective rotary shafts of one intermediate transfer member and two photosensitive members were constructed in the form of common side plates (FIG. 19). Plastic (polycarbonate) having a thickness of 3 mm was used for the side plates. In the examples 1 through 3, the photosensitive members and the intermediate transfer member were supported separately from each other, and the tests were performed after the apparatus has been adjusted. In contrast, in the example 4, these three members were integrally supported, and the result of the test was measured without adjustment. The example 4 is the same as example 1 with regard to other test conditions.

The positional dislocation occurred between the two color photosensitive members without adjustment was 48 microns, and this result was satisfactory.

(EXAMPLE 5)

In the construction of the apparatus in accordance with the first embodiment, the photosensitive members were driven independently of each other. They were each controlled such that the photosensitive members had substantially the same surface velocity. In contrast, in the example 5, one drive source was used for driving the photosensitive members, and the torque was transmitted to the surface of the photosensitive members through use of a torque transmission roller 76 shown in FIG. 13. The torque transmission roller 76 was rotated by a drive source (not shown) connected to the center of the rotary shaft of the torque transmission roller 76. The torque transmission roller 76 comprises a metal center and a rubber layer which has a width of 3 mm and is formed on the surface of the metal center to a thickness of 1 mm. The torque transmission roller 76 comes into contact with the side edge on one side of each of the photosensitive members 1, 2 and transmits torque in the form of frictional force.

With these conditions, the same test as that performed in the example 1 was performed, and a positional dislocation of 43 microns substantially equivalent to that of the example 1 was obtained.

As has been described above, in accordance with the present invention, it is possible to realize a simple, compact, and inexpensive color image forming apparatus which provides a high degree of productivity of an image and does not need for the complicated control of the positions of toner images.

WHAT IS CLAIMED IS:

1. An image forming apparatus which forms a color image by the steps of forming a latent image, for each of colors, developing the latent image through use of each color toner to produce a monochrome image for each color, superimposing the monochrome images on each other on predetermined paper, and fixing the images on the paper, said apparatus comprising:

three or more rotary image carriers which have a cylindrical profile and are positioned so as to share a tangential plane in common, wherein latent images for respective monochrome images are each formed on the surface of the rotary image carriers while the rotary image carriers are in rotation about their central axes, and the latent images are developed to produce monochrome toner images through use of toner of respective colors; and one or a plurality of rotary transfer members which each have a cylindrical profile and a central axis and are positioned in contact with or in close proximity to the rotary image carriers with the central axes of the rotary image carriers being fixed in position relative to the central axes of the rotary transfer members;

wherein the monochrome toner images formed on the rotary image carriers, which are in contact with or in close proximity to the rotary transfer members, are transferred to the surface of, or paper carried on, the rotary transfer members.

2. The image forming apparatus as defined in claim 1, further comprising:

a common support member for supporting the three or more rotary image carriers and one or the plurality of rotary transfer members.

3. The image forming apparatus as defined in claim 1, further comprising a common drive source for rotating the three or more rotary image carriers.

4. The image forming apparatus as defined in claim 1, wherein either the rotary image carriers or the rotary transfer members have an elastic or resilient surface.

5. An image forming apparatus which forms a color image by the steps of forming a latent image, for each of colors, developing the latent image through use of each color toner to produce a monochrome image for each color, superimposing the monochrome images on each other on predetermined paper, and fixing the images on the paper, said apparatus comprising:

a first constituent unit including one or more first rotary image carriers which have a cylindrical profile, wherein latent images for respective monochrome images are each formed on the surface of the first rotary image carriers while the first rotary image carriers are in rotation, and the latent images are developed through use of toner of respective colors, and a first rotary transfer member which has a cylindrical profile and is positioned in contact with or in close proximity to the first rotary image carriers, wherein the monochrome toner images formed on the first rotary image carriers, which are in contact with or in close proximity to the first rotary transfer member, are transferred to the surface of, or paper carried on, the first rotary transfer member while it is in rotation; and a second constituent unit including one or more second rotary image carriers which have a cylindrical profile and rotary shafts in parallel with rotary shafts of the first rotary image carriers and are positioned so as to be in reflectional symmetry with respect to the first rotary image carriers with reference to the plane of symmetry, wherein latent images for respective monochrome images are each formed on the surface of the second rotary image carriers while the second rotary image carriers are in rotation, and the latent images are developed to thereby produce monochrome toner images through use of toner of respective colors, and a second rotary transfer member which has a cylindrical profile and a rotary shaft in parallel with a rotary shaft of the first rotary transfer member and is positioned in contact with or in close proximity to the second rotary image carriers so as to be in reflectional symmetry with respect to the first rotary transfer member with reference to the plane of symmetry, wherein the monochrome toner images formed on the second rotary image carriers, which are in contact with or in close proximity to the second rotary transfer member, are transferred to the surface of, or paper carried on, the second rotary transfer member while it is in rotation.

6. The image forming apparatus as defined in claim 5, wherein the one or more first rotary image carriers and the one or more second rotary image carriers are arranged so as to share a tangential plane in common.

7. The image forming apparatus as defined in claim 5, wherein the first constituent unit comprises two first rotary image carriers, and the second constituent unit comprises two second rotary image carriers; and the first and second constituent units are arranged so as to be in reflectional symmetry with respect to the plane of symmetry.

8. The image forming apparatus as defined in claim 5, further comprising a common support for supporting the one or more first rotary image carriers, the first rotary transfer member, the one or more second rotary image carriers, and the second rotary transfer member in a rotatable manner.

9. The image forming apparatus as defined in claim 5, further comprising:

a first common support for supporting the one or more first rotary image carriers and the first rotary transfer member in a rotatable manner; and a second common support for supporting the one or more second rotary image carriers and the second rotary transfer member in a rotatable manner.

10. The image forming apparatus as defined in claim 5, wherein the first and second rotary transfer members are positioned so as to be in contact with or in proximity to each other and to rotate in opposite directions.

11. The image forming apparatus as defined in claim 5, further comprising a common drive source for rotating the one or more first rotary image carriers and the one or more second rotary image carriers.

12. The image forming apparatus as defined in claim 5, wherein either the one or more first and second rotary image carriers or the first and second rotary transfer members have an elastic or resilient surface.

13. An image forming method for use with an image forming apparatus which forms a color image by the steps of forming a latent image, for each of colors, developing the latent image through use of each color toner to thereby produce a monochrome image for each color, superimposing the monochrome images on each other on predetermined paper, and fixing the images on the paper; and which comprises one or more first rotary image carriers which have a cylindrical profile, wherein latent images for respective monochrome images are each formed on the surface of the first rotary image carriers while the first rotary image carriers are in rotation, and the latent images are developed through use of toner of respective colors; a first rotary transfer member which has a cylindrical profile and is positioned in contact with or in close proximity to the first rotary image carriers, a third rotary transfer member which has a cylindrical profile and is positioned in contact with or in close proximity to the first rotary transfer member; one or more second rotary image carriers which have a cylindrical profile and rotary shafts in parallel with rotary shafts of the first rotary image carriers and are positioned so as to be in reflectional symmetry with respect to the first rotary image carriers with reference to a plane of symmetry, wherein latent images for respective monochrome images are each formed on the surface of the second rotary image carriers while the second rotary image carriers are in rotation, and the latent images are developed to thereby produce monochrome toner images through use of toner of respective colors; and a second rotary transfer member which has a cylindrical profile and a rotary shaft in parallel with a rotary shaft of the first rotary transfer member and is positioned in contact with or in close proximity to the second rotary image carriers so as to be in reflectional symmetry with respect to the first rotary transfer member with reference to the plane of symmetry, and said second rotary transfer member also being positioned in contact with or in close proximity to the third rotary transfer member; said method comprising the steps of:

forming a first monochrome toner image on a first rotary image carrier to transfer the first monochrome toner image to the first rotary transfer member, while forming a second monochrome toner image on a second rotary image carrier to transfer the second monochrome toner image to the second rotary transfer member;

transferring the first monochrome toner image from the first rotary transfer member to the third rotary transfer member; transferring the second monochrome toner image from the second rotary transfer member to the third rotary transfer member; and transferring the first and second monochrome toner images on the third rotary transfer member to the predetermined paper.

* * * * *